US009918598B2

(12) United States Patent
Osborne

(10) Patent No.: US 9,918,598 B2
(45) Date of Patent: Mar. 20, 2018

(54) SIDE-BY-SIDE TISSUE DISPENSER DOOR RESTRICTION MECHANISM

(75) Inventor: Charles Agnew Osborne, Cumming, GA (US)

(73) Assignee: Solaris Paper, Inc., Alpharetta, GA (US)

( * ) Notice: Subject to any disclaimer, the term of this patent is extended or adjusted under 35 U.S.C. 154(b) by 0 days.

(21) Appl. No.: 13/441,472

(22) Filed: Apr. 6, 2012

(65) Prior Publication Data

US 2012/0256036 A1 Oct. 11, 2012

Related U.S. Application Data

(60) Provisional application No. 61/472,296, filed on Apr. 6, 2011.

(51) Int. Cl.

| | |
|---|---|
| ***A47K 10/38*** | (2006.01) |
| *A47K 10/36* | (2006.01) |
| *A47K 10/32* | (2006.01) |

(52) U.S. Cl.

CPC ..... *A47K 10/38* (2013.01); *A47K 10/36* (2013.01); *A47K 10/3687* (2013.01); *A47K 2010/3246* (2013.01)

(58) Field of Classification Search

CPC ..... A47K 10/38; A47K 10/3845; A47K 10/3854; A47K 10/32; A47K 10/34; A47K 2010/32; A47K 2010/3253; A47K 2010/3233; A47K 10/3662; A47K 2010/3681; B65H 35/006; B65H 16/021; B65H 16/023; B65H 19/12; B65H 19/126; A47L 2010/3253; A47L 2010/3233

USPC ..... 242/594, 594.3, 594.4, 594.5, 594.6, 242/598.5, 598.6, 560

See application file for complete search history.

(56) References Cited

U.S. PATENT DOCUMENTS

| | | | | |
|---|---|---|---|---|
| 3,010,670 | A * | 11/1961 | Jones et al. | 242/560 |
| 3,620,466 | A * | 11/1971 | Bump | 242/560.1 |
| 3,637,276 | A * | 1/1972 | Bump | A47K 10/38 242/560 |
| 4,285,474 | A * | 8/1981 | Perez | 242/422.5 |
| 4,375,874 | A * | 3/1983 | Leotta et al. | 242/560 |
| 5,265,816 | A | 11/1993 | Collins | |
| 5,314,131 | A | 5/1994 | McCanless et al. | |
| 5,868,335 | A * | 2/1999 | Lebrun | 242/560.3 |
| 5,954,256 | A * | 9/1999 | Niada | 242/598.6 |
| 6,202,956 | B1 | 3/2001 | Grasso et al. | |

(Continued)

FOREIGN PATENT DOCUMENTS

GB 2210021 A * 6/1989

*Primary Examiner* — Sang K Kim
*Assistant Examiner* — Nathaniel L Adams
(74) *Attorney, Agent, or Firm* — Fish IP Law, LLC

(57) ABSTRACT

A dispenser for storing and dispensing multiple rolls of sheet material is described. The rolls are held in place within the interior space of the housing by a pair of spindle holders. The housing front cover has an opening and a slidable door disposed therein to provide access to the rolls. A restricting member is movably coupled to the housing interior and biased to move in a direct towards an outmost winding of a roll. As the roll is dispensed, the restricting member moves out of the pathway of the door, eventually allowing a user to slide the door across the opening so that a second roll may be accessed.

20 Claims, 3 Drawing Sheets

(56) References Cited

U.S. PATENT DOCUMENTS

| | | | | |
|---|---|---|---|---|
| 7,083,138 | B2 | 8/2006 | Elliott et al. | |
| 2010/0206979 | A1 * | 8/2010 | Collins ..... | A47K 10/3687<br>242/560 |

* cited by examiner

SIDE-BY-SIDE TISSUE DISPENSER DOOR RESTRICTION MECHANISM

This application claims the benefit of priority to provisional application Ser. No. 61/472,296 filed on Apr. 6, 2011.

FIELD OF THE INVENTION

The field of the invention relates to dispensing rolls of sheet material, and more particularly to toilet tissue dispensers for dispensing two rolls on an alternate basis.

BACKGROUND

Dispensers for dispensing two or more rolls of paper product (e.g., toilet tissue, paper towels) are known. In many circumstances, it is advantageous to limit access to only one roll at any given time, thus providing a "reserve roll" (e.g., a backup roll) that cannot be accessed until a "primary roll" is completely depleted. Such dispensers are usually, but not exclusively, employed in institutional environments such as public rest rooms.

Paper product dispensers of the type discussed above are described in U.S. Pat. Nos. 5,265,816, 6,202,956, 5,314,131, and 7,083,138. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unfortunately, the dispensers described in the above references are complex, difficult to manufacture/assemble, and have a high part count. It would be advantageous to provide a paper product dispenser with a restricted-access reserve compartment, wherein the dispenser is simple, reliable, and has a low manufacturing cost.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Thus, there is still a need for improved paper product dispensers that restrict access to a reserve roll.

SUMMARY OF THE INVENTION

The inventive subject matter provides apparatus, systems and methods in which a dispenser for dispensing rolls of sheet material (e.g., paper products) includes a housing having an opening and a slidable door for accessing an interior space (e.g., internal compartment) of the housing. The interior space is large enough to store at least two rolls of sheet material. A restricting member is movably disposed within the interior space of the housing, and is configured to (i) move as a function of a diameter of one of the rolls and (ii) restrict the door from sliding until a desired diameter of the roll is obtained. In this manner, one of the rolls is stored in "reserve" (i.e., it cannot be accessed) until the other roll is completely depleted (or at least depleted up to a predetermined threshold).

In one aspect of some embodiments, the dispenser further includes two or more pairs of spindle holders disposed in the interior space. Each pair of spindle holders is configured to removably receive a spindle. The spindle can be inserted into a core of a roll of sheet material and then coupled with the spindle holders so that the roll of sheet material can be stored in, and dispensed from, the interior space of the dispenser housing.

In other aspects of some embodiments, the housing includes a second restricting member. Each restricting member is configured to move as a function of a diameter of a different roll. In this manner, the door is restricted from moving to a first position until a first roll is depleted. Once in the first position, the door is restricted from moving into a second position until the second roll is depleted.

In yet other aspects, the restricting member is rotatably coupled with the housing. The restricting member has a paddle portion (e.g., a first end) that is biased to rotate such that the paddle portion either directly or indirectly contacts an outmost winding of the roll. The restricting member also has a stop (e.g., a second end) that is configured to extend into a pathway of the door. The stop is also configured to move out of the pathway as the roll is depleted. In some embodiments, the door has a protrusion extending from the door's interior surface. The stop is configured to interfere with the pathway of the protrusion as a function of the diameter of the roll, thus restricting the door from sliding until the roll is sufficiently depleted.

In another aspect of some embodiments, the housing's opening has a track that provides a slidable engagement for the door. The length of the track defines the pathway traveled by the door.

Various objects, features, aspects, and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
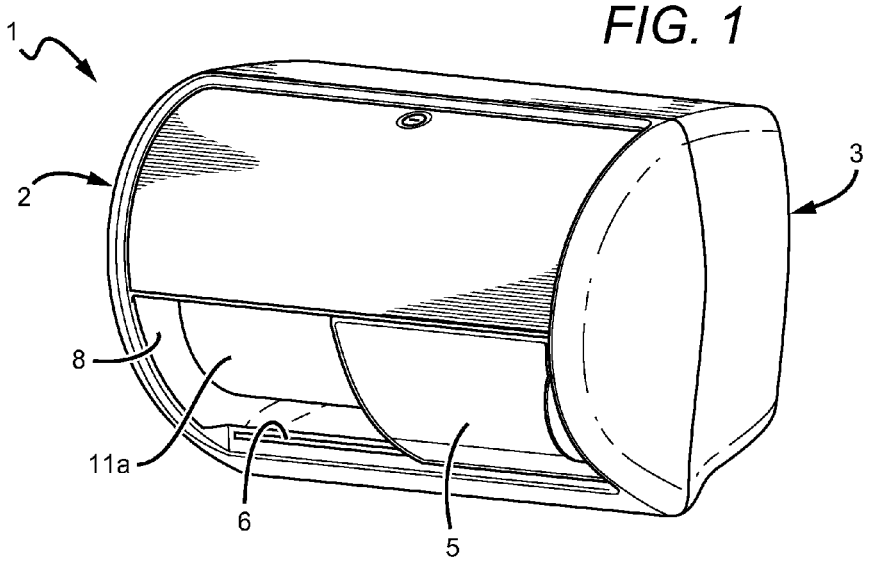
FIG. 1 is a perspective view of one embodiment of a toilet tissue dispenser shown with front cover closed and loaded with toilet tissue.

FIG. 1 shows a side-by-side toilet tissue dispenser 1 in a ready-to-use state. Dispenser 1 is a two-part housing comprising a front cover 2 rotatably coupled with a rear housing 3 via hinge 17 (see FIG. 2). Front cover 2 and rear housing 3 could alternatively be translatably coupled and could comprise three or more components without departing from the inventive subject matter disclosed herein. The combination of front cover 2 and rear housing 3 define an interior space 4 (see FIG. 2) for storing rolls of toilet tissue 11*a* and 11*b*. Front cover 2 has an opening 8 and a track 6 disposed on a border of opening 8. Slidable door 5 is disposed in track 6 and slides across opening 8 to provide access to rolls 11*a* and 11*b*. Only one of rolls 11*a* and 11*b* are accessible at any given time due to the presence of door 5.

Interior space 4 is sized and dimensioned to completely enclose rolls 11*a* and 11*b*. Alternatively, dispenser 1 could be configured such that rolls 11*a* and 11*b* are only partially enclosed. Furthermore, the size and shape of interior space 4 (and thus front cover 2 and rear housing 3) can be configured to store different types (e.g., coreless, solid-core, etc.), sizes (e.g., 3 inches diameter, 6 inches diameter, etc.), and/or materials (e.g., paper, plastic, aluminum, etc) of sheet material.

Figure 2:
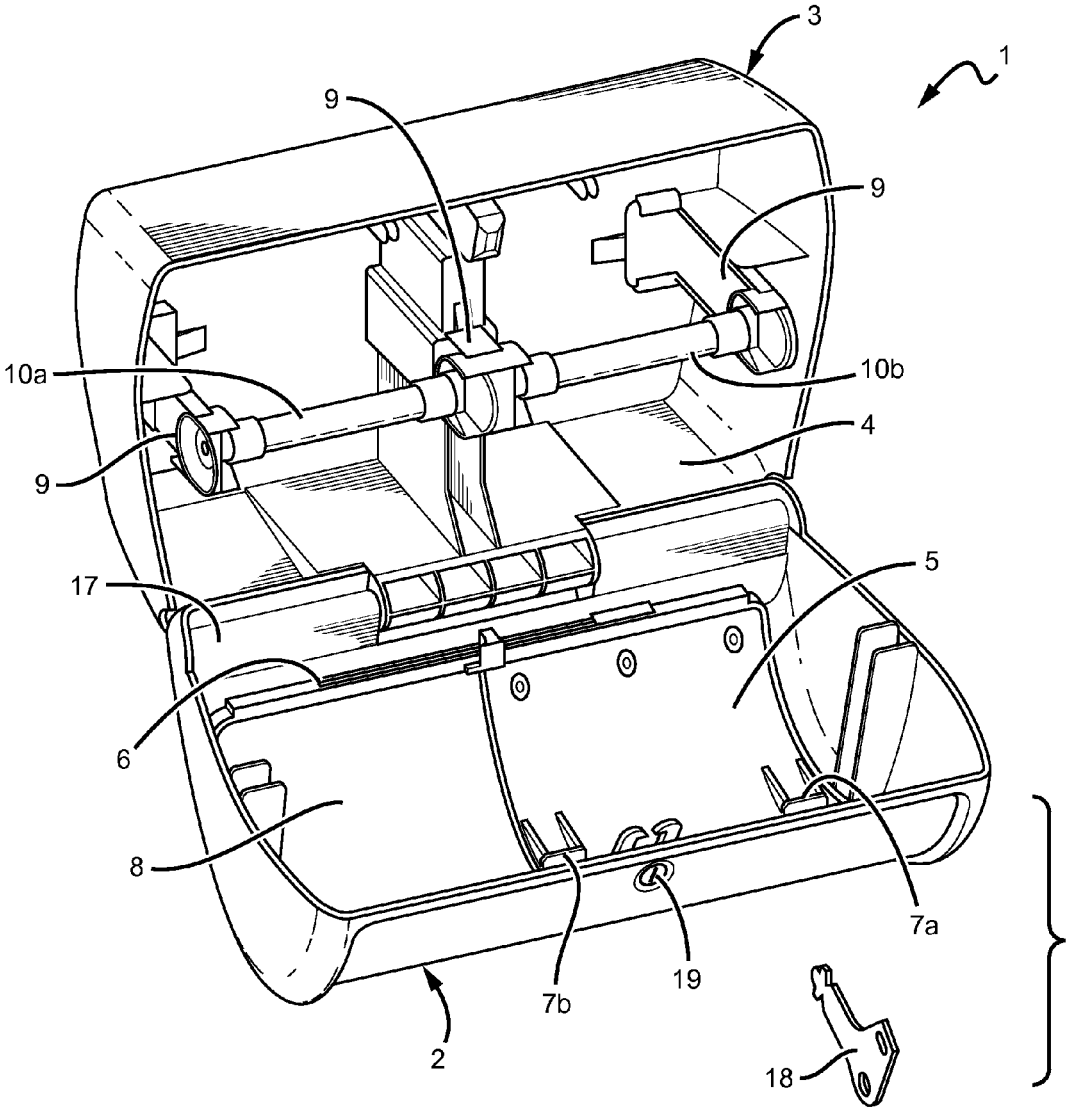
FIG. 2 is a perspective view of the dispenser of FIG. 1, shown with front cover open and toilet tissue removed.

FIG. 2 shows dispenser 1 with front cover 2 opened and rolls 11*a* and 11*b* removed. Front cover 2 has a key 18 and lock mechanism 19 for locking front cover to rear housing 3. With front cover 2 open, interior space 4 is readily visible. Within space 4 are two pairs of spindle holders 9 and two spindles 10*a* and 10*b* for storing and dispensing two rolls of toilet tissue. FIG. 2 also shows the interior surface of door 5, which has a first protrusion 7*a* and a second protrusion 7*b* extending from the interior surface of door 5 and into space 4. Door 5 is disposed in track 6 and is slidable within opening 8 along a pathway. As used herein, "pathway" means the space occupied by the door, including the door's protrusions, as it slides within an opening.

Spindles 10*a* and 10*b* can either be of a fixed length, or of a variable length. Furthermore, spindles 10*a* and 10*b* can be configured for use with "reduced-core," "standard-core," and/or "coreless" rolls of sheet material. In other embodiments, spindles 10*a* and 10*b* can be completely eliminated and spindle holders 9 can be configured to engage a "solid-core" roll of sheet material. As used herein, "solid-core" means a roll of sheet material that has substantially no center aperture. As used herein, "coreless" means a roll of sheet material having no separate core material (e.g., cardboard core for toilet tissue). As used herein, "reduced-core" means a roll of product that has a core diameter substantially smaller than a standard diameter size.

Figure 3:
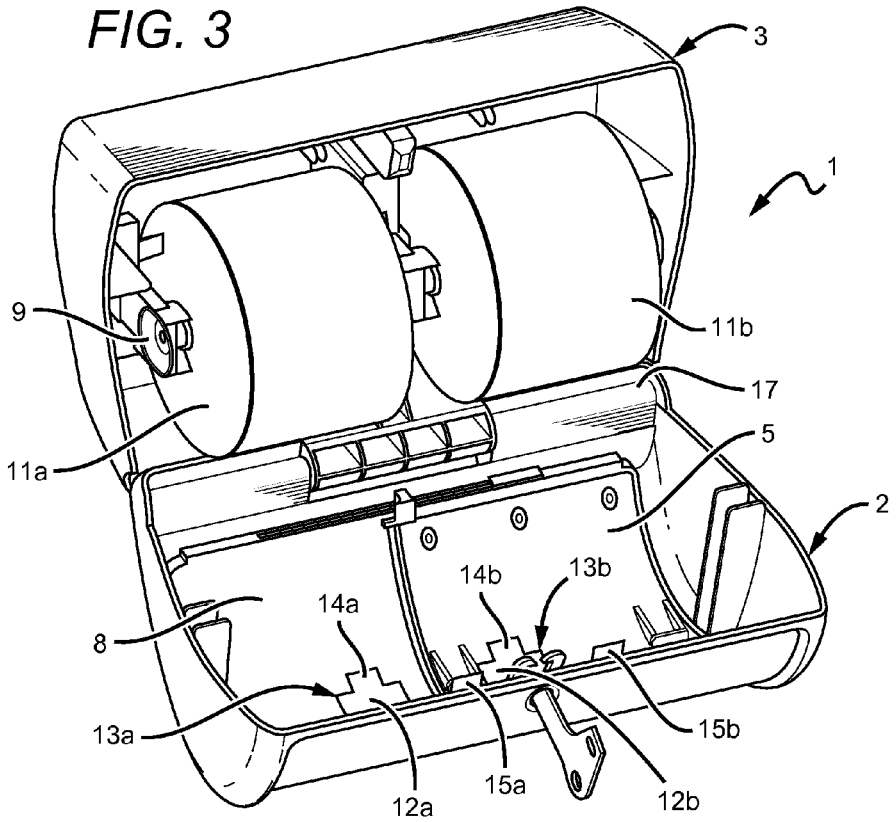
FIG. 3 is a perspective view of the dispenser of FIG. 1, shown with front cover open and loaded with toilet tissue.

FIG. 3 shows dispenser 1 with front cover 2 open and rolls of toilet tissue 11*a* and 11*b* loaded in interior space 4. Rotatably coupled to front cover 2 are first restricting member 13*a* and second restricting member 13*b*. Restricting members 13*a* and 13*b* each have a first end and a second end, namely, paddle portions 15*a* and 15*b* and stops 14*a* and 14*b*, respectively. The function of restricting members 13*a* and 13*b* is best illustrated by FIGS. 4 and 5.

Figure 4:
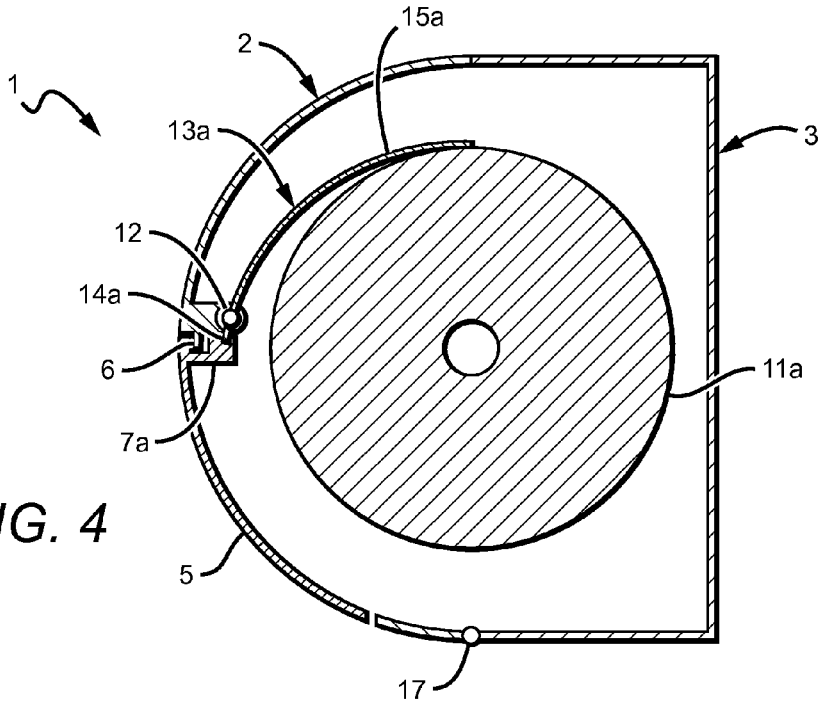
FIG. 4 is a section view of the side of the dispenser of FIG. 1, shown with a full roll of toilet tissue.
Figure 5:
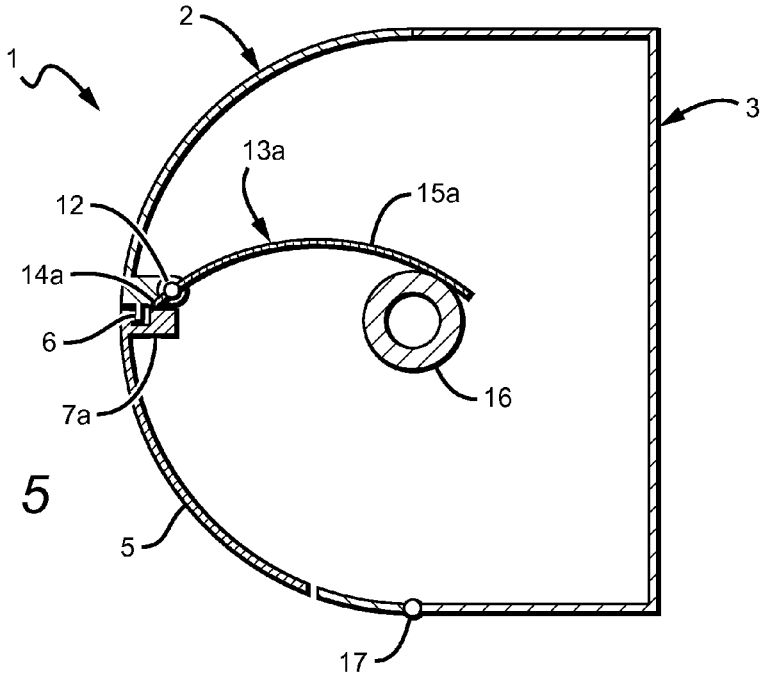
FIG. 5 is a section view of the side of the dispenser of FIG. 1, shown with a core of a depleted roll of toilet tissue.

FIGS. 4 and 5 show a side section view of dispenser 1 and restricting member 13*a*. Restricting member 13*a* is rotatably coupled to front cover 2 via hinge 12*a*. Hinge 12*a* is disposed on an interior surface of front cover 2. Restricting member 13*a* is biased to rotate in a clockwise direction such that paddle portion 15*a* rests on the outmost winding of roll 11*a*. The bias can be provided by appropriately positioning the weight of paddle portion 15*a* above roll 11*a* within a field of gravity, or alternatively, using a spring. As roll 11*a* is dispensed and depleted, restricting member 13*a* rotates clockwise about hinge 12*a*, causing stop 14*a* to rotate out of the pathway of door 5. Eventually, roll 11*a* is depleted until core 16 is exposed. Restricting member 13*b* functions similar to 13*a*, except that restricting member 13*b* contacts an outmost winding of roll 11*b* and interferes with protrusion 7*b* of door 5.

FIG. 4 shows stop 14*a* disposed in the pathway of protrusion 7*a* and FIG. 5 shows 14*a* out of the pathway of protrusion 7*a*. One of ordinary skill in the art will appreciate that stop 14*a* need not completely pass through pathway in order to impede door 5 from sliding.

Stop 14*a* and protrusion 7*a* are configured to interfere with one another until a predetermined diameter (i.e., "threshold") of roll 11*a* is reached. Once the threshold is reached, a user can then slide door 5 along track 6 in order to access roll 11*b*. The threshold can be defined by the diameter of an empty core (i.e., 100% depletion of the roll), or by some other desirable threshold (e.g., 95% depleted, 97% depleted, 99% depleted, etc.) as determined by a user.

In alternative embodiments, restricting members can be translationally, rather than rotatably, coupled to a dispenser housing. In such embodiments, the restricting member is biased to translate towards an outmost winding of a roll. As the roll is dispensed, the restricting member translates in a direction and out of the pathway of the door.

As used herein, "stop" simply refers to a portion of the restricting member that is appropriately sized and dimensioned to impede a dispenser door from moving further. The term "stop" is not intended to require any coupling or engagement with the door.

As used herein, "paddle" means a surface. The term "paddle" is not intended to imply any particular size or shape. As such, the term paddle includes flat and curved surfaces.

The inventive subject matter is not intended to be limited to "paper products." One of ordinary skill in the art will appreciate that the inventive concepts discussed herein can be applied to any rolled sheet material, including non-absorbent and/or non-paper products, such as rolls of stamps, tickets, plastic wrap, and aluminum foil. The inventive subject matter is also not intended to be limited to "side-by-side" dispensers. One of ordinary skill in the art would appreciate that the inventive concepts can be equally applied to horizontal dispensers, vertical dispensers, and any other orientation.

In addition, the number of rolls per dispenser is not intended to limit the present application. One of ordinary skill in the art will appreciate that dispenser 1 can be modified to store any number of rolls of sheet material. Furthermore, dispenser 1 can be modified with a sufficient number of doors, openings, tracks, and restricting members in order to limit access to any desired number of rolls at any given time (e.g., 2 out of 5 rolls are accessible) and as a function of the diameter of other rolls of toilet tissue within the dispenser.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used herein, "sides" means a surface of a structure. As such, "side" does not refer to any particular orientation or location and can include lateral surfaces, front/back surfaces, and/or top/bottom surfaces. The term "side" includes planar as well as non-planar surfaces.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dispenser for dispensing rolls of sheet material, comprising:

a housing having an opening that provides access to an interior space, wherein the interior space has a first portion and a second portion that are configured to store a first roll and a second roll of sheet material, respectively;

a first pair of spindle holders disposed in the first portion of the interior space and a second pair of spindle holders disposed in the second portion of the interior space, wherein the first and second pairs of spindle holders are configured to removably receive a first and a second spindle, respectively, and wherein the first and second pairs of spindle holders define a common axis about which the first and second spindles rotate;

a door slideably disposed in the opening of the housing, wherein the door translationally slides across the opening between a first position and a second position along a pathway;

wherein, in the first position, the door allows access to the first portion of the interior space and limits access to the second portion of the interior space;

wherein, in the second position, the door limits access to the first portion of the interior space and allows access to the second portion of the interior space; and a first restricting member movably disposed with respect to the housing, wherein the first restricting member (i) is biased to move in a radial direction toward the axis, (ii) restricts the door from sliding across the opening until the first restricting member reaches a threshold distance from the first spindle, and (iii) rests on an outmost winding of the first roll when the first roll is coupled with the first spindle.

2. The dispenser of claim 1, wherein the first and second pairs of spindle holders are configured to simultaneously receive the first and second spindles, respectively.

3. The dispenser of claim 1, wherein the first spindle is of a fixed length.

4. The dispenser of claim 1, wherein the first spindle is of a variable length.

5. The dispenser of claim 1, further comprising a second restricting member movably disposed with respect to the housing, and configured to (i) be movable as a function of a diameter of the second roll and (ii) restrict the door from sliding until a desired diameter of the second roll is obtained.

6. The dispenser of claim 5, wherein the second restricting member has a paddle portion configured to rest on an outmost winding of the second roll.

7. The dispenser of claim 6, wherein the first and second restricting members have a first and second stop, respectively.

8. The dispenser of claim 7, wherein the door has a first protrusion and a second protrusion extending from an interior surface of the door.

9. The dispenser of claim 8, wherein the first and second protrusions are configured to interfere with the first and second stops of the first and second restricting members, respectively, as a function of a diameter of the first and second rolls, respectively.

10. The dispenser of claim 1, wherein the restricting member is rotatably coupled to an interior surface of the housing.

11. The dispenser of claim 1, further comprising a track disposed in a border of the opening.

12. The dispenser of claim 11, wherein the door is slideably disposed in the track.

13. A dispenser for dispensing rolls of sheet material, comprising:

a housing having an opening that provides access to an interior space having a first portion and a second portion, wherein the interior space has a first spindle holder and a second spindle holder that (i) are disposed in the first portion and (ii) define a common axis;

a door slideably disposed in the opening of the housing, wherein the door slides translationally along a pathway across the opening between a first position and a second position, and in a direction that is parallel to the common axis;

wherein, in the first position, the door allows access to the first portion of the interior space and limits access to the second portion of the interior space;

wherein, in the second position, the door limits access to the first portion of the interior space and allows access to the second portion of the interior space; and a restricting member at least partially disposed in the interior space and rotatably coupled with the housing;

wherein the restricting member comprises a first end and a second end;

wherein the first end rests on an outmost winding of the first roll when the first roll is stored in the interior space of the housing; and wherein the restricting member is biased to rotate such that (i) the first end rotates toward the opening of the housing and further into the first portion of the interior space toward a center of the first roll of sheet material when the first roll of sheet material is stored in the interior space and (ii) the second end rotates out of the pathway as the first roll of sheet material is depleted.

14. The dispenser of claim 13, wherein the restricting member is sized, dimensioned, and positioned, such that the second end completely rotates out of the pathway when the first roll of sheet material is more than 95% depleted.

15. The dispenser of claim 13, wherein the first end comprises a curved paddle.

16. The dispenser of claim 13, wherein the housing comprising a front cover rotatably coupled with a rear member.

17. The dispenser of claim 13, wherein the door includes a first protrusion and a second protrusion extending from an interior surface of the door.

18. The dispenser of claim 17, wherein the first and second protrusions are configured to slide along the pathway.

19. The dispenser of claim 13, further comprising a horizontal track disposed on a border of the opening, and wherein the horizontal track is configured to allow the door to slide along the pathway.

20. The dispenser of claim 13, wherein the first portion and second portion of the interior space are separated by a partition.

* * * * *